US008366231B2

(12) United States Patent
Karin et al.

(10) Patent No.: US 8,366,231 B2
(45) Date of Patent: Feb. 5, 2013

(54) INKJET PRINTING

(75) Inventors: Nir Karin, Givataim (IL); Roni Mor, Kochav Yair (IL); Ran Vilk, Qiryat Ono (IL); Vladimir Naivelt, Petach Tiqwa (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1107 days.

(21) Appl. No.: 11/769,881

(22) Filed: Jun. 28, 2007

(65) Prior Publication Data

US 2009/0002407 A1 Jan. 1, 2009

(51) Int. Cl.
*B41J 29/38* (2006.01)
*B41J 29/377* (2006.01)

(52) U.S. Cl. ..... 347/17; 347/13; 347/18

(58) Field of Classification Search ..... 347/17, 347/18, 13, 42, 89
See application file for complete search history.

(56) References Cited

U.S. PATENT DOCUMENTS

| | | | | |
|---|---|---|---|---|
| 5,343,227 | A * | 8/1994 | Hirosawa et al. | 347/42 |
| 5,512,924 | A * | 4/1996 | Takada et al. | 347/18 |
| 5,969,736 | A | 10/1999 | Field et al. | |
| 6,679,596 | B2 * | 1/2004 | Boyd et al. | 347/89 |
| 2004/0027428 | A1 * | 2/2004 | Silverbrook et al. | 347/85 |
| 2006/0284914 | A1 * | 12/2006 | Murakami et al. | 347/17 |
| 2007/0120884 | A1 * | 5/2007 | Lecheheb | 347/17 |
| 2008/0273910 | A1 * | 11/2008 | Verlinden et al. | 400/352 |

* cited by examiner

*Primary Examiner* — Charlie Peng
*Assistant Examiner* — Hung Lam

(57) ABSTRACT

A carrier for an array comprising a plurality of print heads, comprises an elongate bar having an ink conduit extending through the bar in a longitudinal direction. The carrier also comprises a print head receiving area adapted to receive or mount the plurality of print heads, and a heat transfer fluid conduit extending through the bar in a longitudinal direction. The carrier is arranged so that each print head received or mounted in the print head receiving area is in fluid communication with the ink conduit, wherein the heat transfer fluid conduit is disposed adjacent both the ink conduit and the print head receiving area. The carrier may comprise two ink conduits and two heat transfer fluid conduits. Heat transfer fluid may in use be conducted along the first and second heat transfer conduits in opposite directions.

17 Claims, 9 Drawing Sheets

INKJET PRINTING

FIELD OF THE INVENTION

The invention relates to inkjet printers of the type comprising an array of print heads. The invention relates particularly, but not exclusively to apparatus and methods for supplying ink to an array of inkjet print heads, for regulating temperature in an array, for regulating pressure of ink in an array, and for removing waste from print heads in an array. The invention also relates to an inkjet printer comprising such apparatus or operating in accordance with such methods.

BACKGROUND OF THE INVENTION

An inkjet printer typically comprises one or more print heads, each of which has a number of nozzles (for example, 100 nozzles) through which ink droplets can be ejected to produce a mark on a substrate at a desired location. The throughput of an inkjet printer relates to the number of nozzles that can be operated simultaneously. In order to increase the throughput, it is known to increase the number of print heads in a printer. Large numbers of print heads, for example tens or hundreds, can be arranged in an assembly known as an array. This is particularly common in large-format industrial printers. An 'array' as used herein means an assembly comprising a plurality of substantially identical print heads arranged to print using the same type of ink. The print heads may be arranged in line or over an area (such as a rectangle).

It is known to deliver ink to each print head in an array via individual tubes. It is desirable to circulate ink through the print head, and typically two tubes are required for each print head. While this arrangement is satisfactory for small arrays, of perhaps 20 print heads, in larger arrays, which may comprise over 150 print heads, the number of tubes (300) it is necessary to connect is prohibitively difficult and complicated. In addition, ink leakage from such tubes is common, and locating the source of a leak among 40 tubes, let alone among 300 tubes, is very difficult. Furthermore, large numbers of tubes result in large pressure length losses inside the ink supply chain.

For maximum printer throughput, it is desirable for the length of an array to equal the length or width of the substrate to be printed. In wide-format printers, such an array might comprise over 300 print heads, and exceed two meters, or even five meters, in length. Ink supply to such an array using the above system would require over 600 tubes and, given the problem of ink leakage, is not commercially viable. We have found it desirable to provide an alternative way of supplying ink to print heads in an array to enable the construction of larger arrays, and to avoid the problem of ink leakage.

During printing, the temperature of the array may vary, as the print heads and associated electronics warm up in use. Temperature variation over the course of a print run is undesirable, as the viscosity of most inks varies with temperature. That variation affects the amount of ink ejected from the nozzles of the print head, and will, for example, cause variation in the colour or intensity of different versions of the same image printed at different temperatures. In addition, some inks, such as ultraviolet inks, only obtain the correct printing properties in a particular, elevated, temperature range, and may not print correctly, or at all, outside that range. Furthermore, the dimensions of the array itself may vary with temperature, adversely affecting the image. We have found it desirable to stabilise the temperature of an array.

An additional problem with existing arrays is known as 'ink surge' or 'water hammer'. That is, when a large number of print head nozzles, for example the nozzles of all 300 or 400 print heads, begin to operate simultaneously, they consume a large amount of ink, forming a zone of lower pressure close to the nozzles and resulting in a delay in ink ejection from the nozzles. Similarly, when a large number of nozzles cease operating simultaneously, excessive pressure builds up in the ink supply system. We have found it desirable to alleviate this effect, and stabilise the ink supply to the array.

SUMMARY OF THE INVENTION

According to one aspect of the invention a carrier for an array of print heads, a printer incorporating such an array, and an associated method, are provided as set out in the claims.

Using such a carrier, printer, or method, ink may be supplied to print heads in an array directly via an integral ink conduit, avoiding the need for a large number of individual tubes. Temperature regulating fluid conducted through the heat transfer fluid conduit is capable of regulating and controlling the temperature of the array carrier, the ink and the print heads simultaneously.

According to another aspect of the invention there is provided a carrier for an array comprising a plurality of print heads, the carrier comprising an elongate integrally formed, e.g. extruded, bar having at least one ink conduit extending longitudinally through the bar and a print head receiving area arranged to receive the plurality of print heads, wherein the carrier is arranged so that a print head received in the print head receiving area is in fluid communication with the ink conduit.

Forming a carrier as a single, for example extruded, bar ensures that there is no possibility of ink leaking from the ink conduit when the carrier is in use, and avoids the need for many individual tubes. Such an array can be built to greater lengths than existing arrays, such as lengths of two, three, four or five metres. An assembly comprising a plurality of array carriers, each arranged to supply a different type of ink, is also provided. An advantage of providing each type of ink on a separate carrier is that replacement of damaged carriers can be performed easily and at low cost, as the other carriers in the assembly need not be affected.

According to a further aspect of the invention there is provided a printer comprising a carrier for an array of print heads, the carrier comprising a print head receiving area, an ink supply conduit arranged in use to supply ink to the print head receiving area, and a heat transfer fluid conduit adjacent the ink supply conduit arranged in use to carry heat transfer fluid, the printer further comprising a controller operable in use to adjust the temperature of the heat transfer fluid, wherein the carrier further comprises a temperature sensor arranged in use to be in contact with ink flowing in the ink conduit, the sensor being configured to send a signal indicative of the temperature of the ink to the controller, and the controller being operable to adjust the temperature of the heat transfer fluid using said signal.

The controller may adjust the temperature of the heat transfer fluid if the signal is outside a predefined temperature range.

Such a carrier allows the temperature of the ink to be closely controlled along the entire length of the ink supply conduit, by altering the temperature of the heat transfer fluid using feedback from the temperature sensor.

According to another aspect of the invention there is provided a carrier for an array of print heads, the carrier comprising a print head receiving area, and an ink conduit arranged in use to supply ink to the print head receiving area, wherein the ink conduit comprises a pressure regulation chamber arranged to be in communication with an atmosphere external to the ink conduit, the chamber in use having a volume of ink in fluid communication with ink in the ink conduit, the volume being arranged to increase or decrease as a pressure within the ink conduit rises above or falls below a pressure of the external atmosphere so as to maintain the pressure within the ink conduit at substantially the same pressure as the pressure of the external atmosphere.

The chamber, or duct, is in communication with the external atmosphere in order to regulate the pressure of ink within the ink conduit. In the event of an increase or decrease in pressure within the ink conduit, the surface of the ink volume within the chamber moves outwardly or inwardly (i.e. towards or away from the ink conduit) to reduce or minimise any differential pressure across the surface, and so ensures the pressure within the conduit remains approximately the same as atmospheric pressure. Rather than the communication being directly via a surface or meniscus on the volume of ink in the pressure regulation chamber, a member, such as a flexible member, such as a film, could be provided over the volume of ink.

According to a further aspect of the invention there is provided a carrier for an array comprising a plurality of printheads, the carrier comprising an elongate bar having at least one ink conduit extending longitudinally through the bar, at least two heat transfer fluid conduits extending longitudinally through the bar, adjacent the ink conduit, the carrier arranged in use such that heat transfer fluid flows along a first heat transfer fluid conduit in a direction opposite to a direction in which heat transfer fluid flows along a second heat transfer fluid conduit.

Such an arrangement helps prevent temperature gradients from developing between the two ends of the carrier.

BRIEF DESCRIPTION OF THE DRAWINGS

Embodiments of the invention will now be described, by way of example only, with reference to the following drawings:

With reference to FIG. 1A, a printer 10 has a flatbed 2 on which a substrate to be printed can be placed. An array 4 of print heads 140 (shown in FIG. 6) is arranged to move relative to the flatbed 2 in the direction of arrow 5, either by movement of the array 4, of the bed 2, or of both.

Figure 1A:
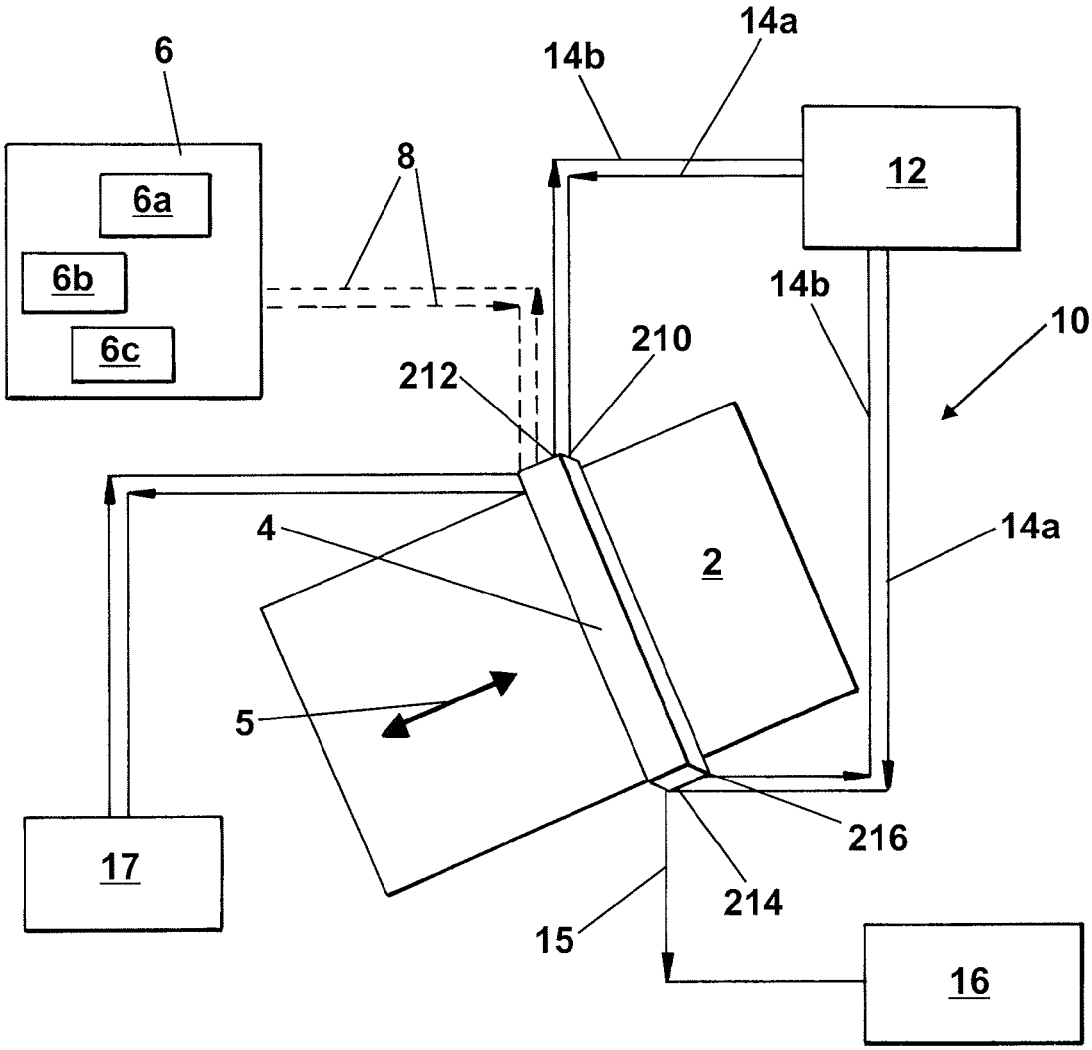
FIG. 1A is a schematic view of an embodiment of a flat bed printer.

Printer 10 includes a controller 6 arranged to control the operation of the printer 10. The controller 6 is arranged to send instructions to and receive information from the print head array carrier 4 via wired connections 8. The controller 6 comprises, inter alia, control software 6*a*, 6*b*, and 6*c* respectively arranged to control and regulate ink supply to the print heads in the array, the temperature of the array, and waste removal from the array, as will be described in more detail below.

The print head array 4 is supplied with ink from an ink tank 12 via one or more tubes 14*a* (two are shown). Excess or unused ink may be returned to the tank 12 via one or more tubes 14*b* (again, two are shown). For simplicity, only one print head array 4 and one ink tank are shown. However, it will be appreciated that usually more than one print head array and ink tank will be provided. The number of arrays may correspond to the number of different types or colours of ink required for printing (conventionally black, magenta, cyan and yellow, although any other combination of more or less ink types could be provided). Alternatively, more than one array may be provided for the same type of ink.

Waste ink and debris collected from the print heads are removed from the array along waste pipe 15 by a pump, in this embodiment a vacuum pump 16.

Figure 1B:
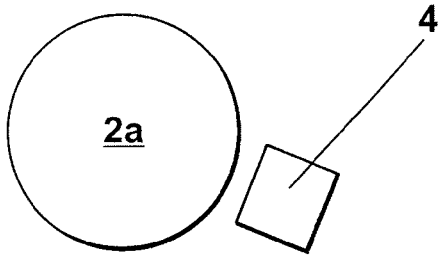
FIG. 1B is a schematic view of a print head array mounted on a drum.

An array 4 is not limited to use in a flatbed printer, as shown in shown in FIG. 1A, and can be used in association with other types of printer, such as a drum (2*a*) printer, as shown in FIG. 1B, a roll-to-roll printer, or any other type of printer.

An embodiment of a print head array carrier will now be described in more detail with reference to FIGS. 2 to 7.

A print head array carrier is an elongate bar 120, also termed a support, beam, or profile, extruded as a single piece from a suitable material. Aluminium, for example, is suitable, as it is light, strong, and capable of withstanding the high temperatures common in printing (between 40 and 45 degrees centigrade). In other embodiments the bar may be formed in one piece by other methods for example moulding, or it may be formed by attaching separate components together, for example using adhesive or welding.

Figure 2:
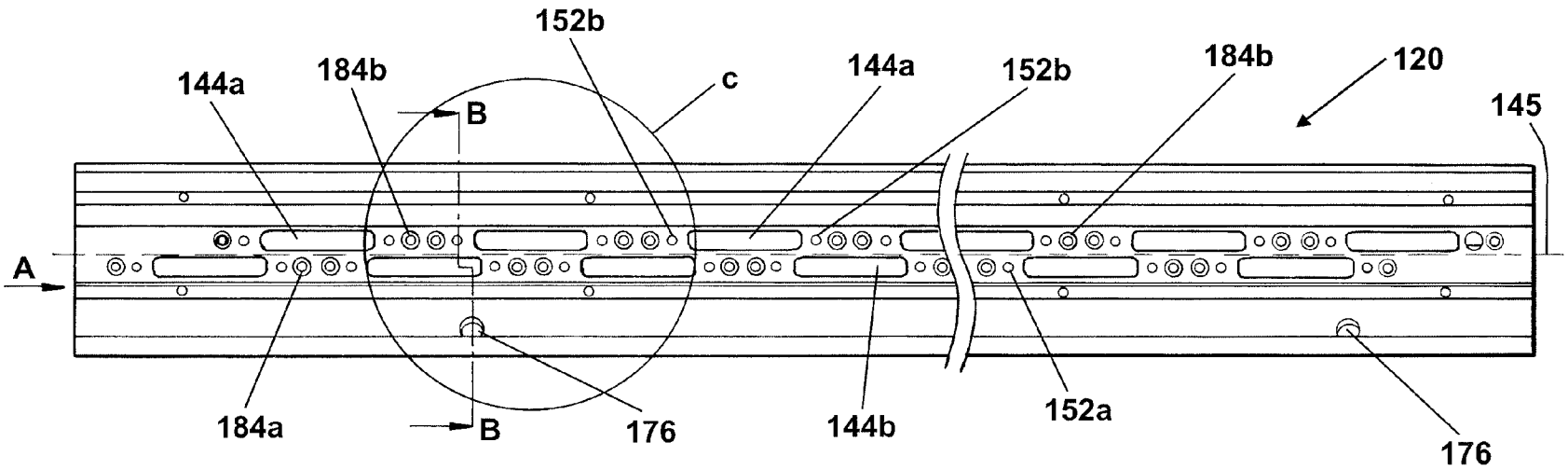
FIG. 2 is a partial front (print-side) view of an embodiment of a print head array carrier.
Figure 7:
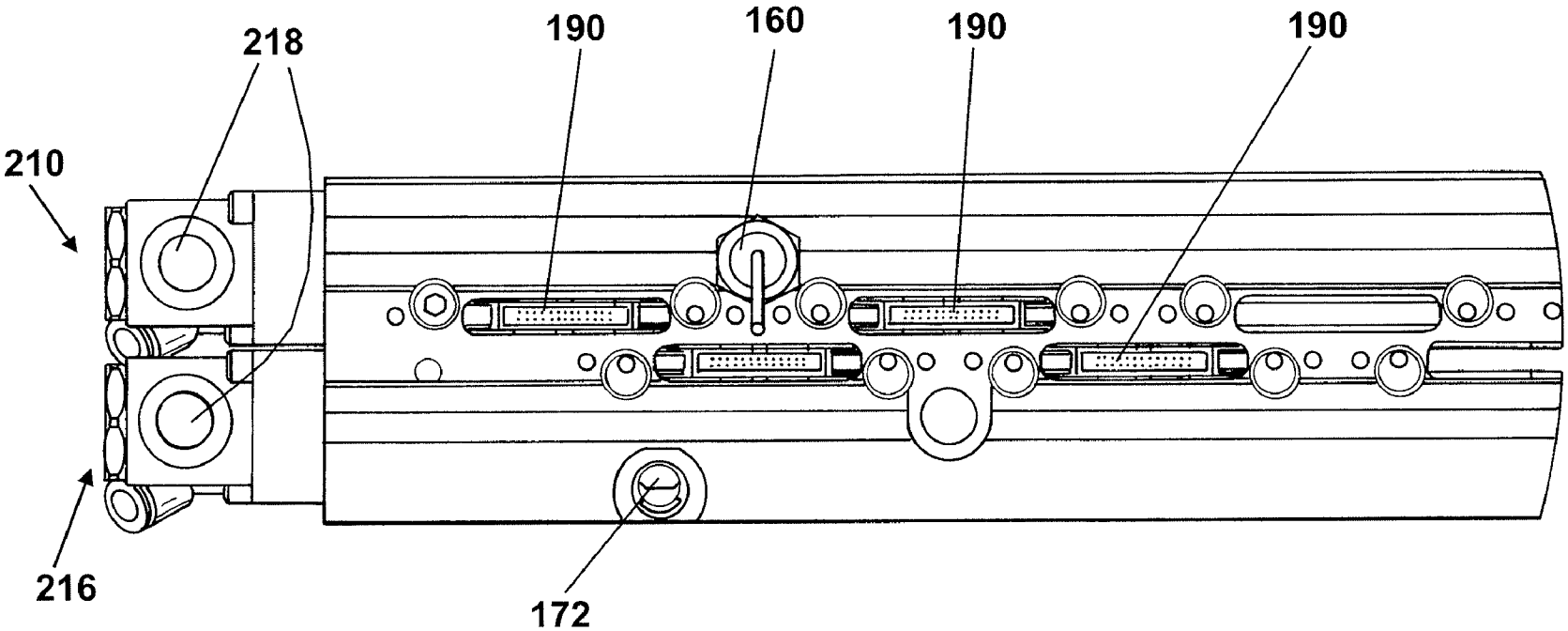
FIG. 7 is a rear view of the print head array carrier of FIG. 6 in the direction marked E.

The bar has a front, printing side 122, shown in FIG. 2, on which in use an array of print heads may be mounted, and a rear side 124, shown in FIG. 7, comprising engagement slots 180 for mounting the bar or profile in a printer.

Figure 6:
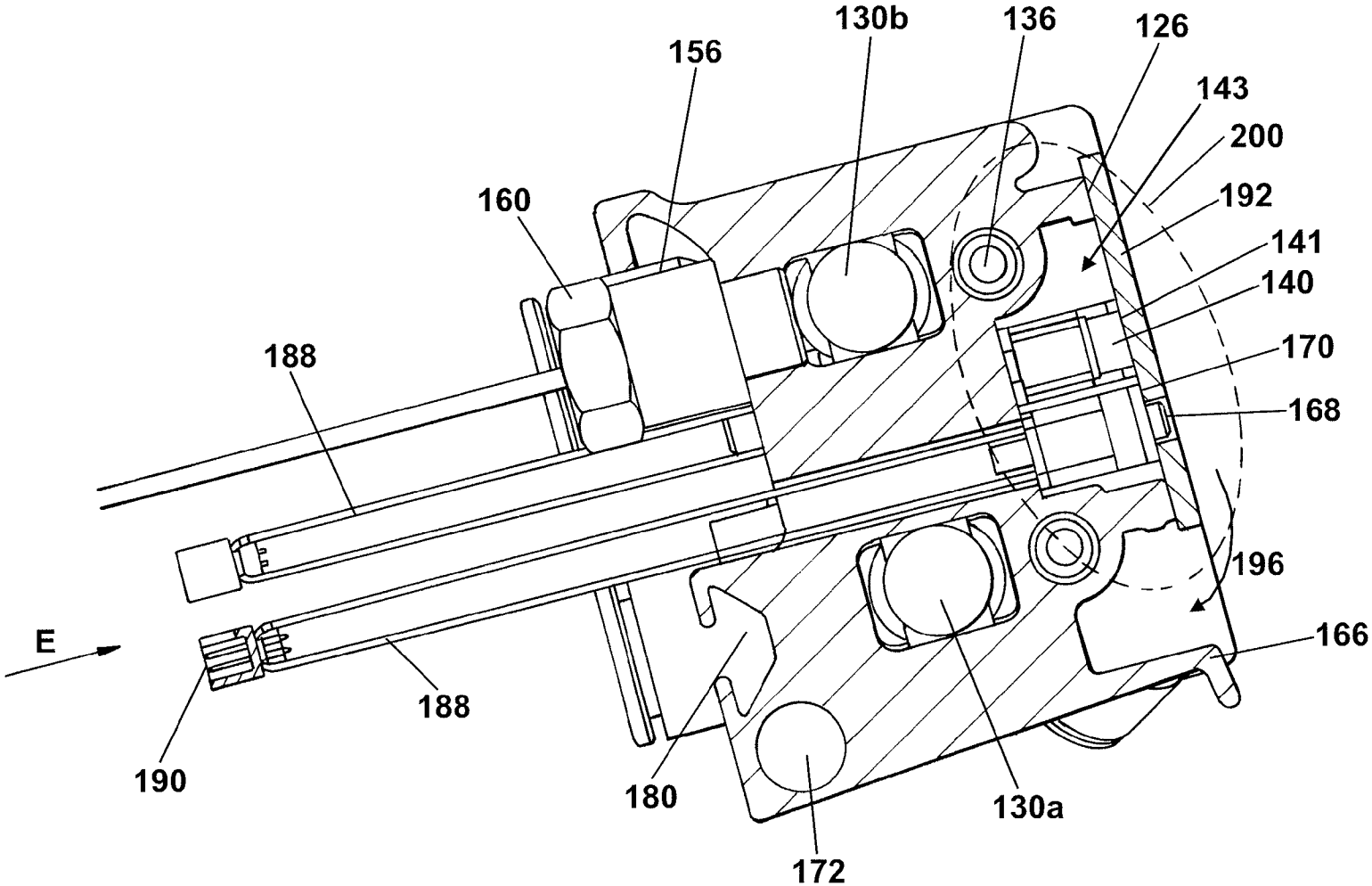
FIG. 6 is a cross-section through an embodiment of a print head array carrier similar to that shown in FIG. 4, additionally including a print head, temperature sensor and sealing plate.

The printing side 122 of the bar 120 has a print head receiving area 200, which has a central groove 143 that provides a recessed area to receive print heads 140 (see FIG. 6). The groove is dimensioned such that an upper surface 141 of each print head is substantially level or below an upper engagement face or surface 126 of the bar. A base of the recess 143 is a similar width to a print head.

Slots 144, into which print head modules can be inserted, are provided through the bar 120 such that print head electronics 188 extend through the bar and out of the rear side of the bar, terminating in connectors 190. The print heads 140 cannot fit through the slots 188 and remain held in the groove 143. The print head electronics 188 heat up when in use.

Arranging the print head modules such that the electronics are substantially external to the carrier bar, and distant from the print heads, reduces the heat transferred from the electronics to the carrier, ink and print heads.

Figure 4:
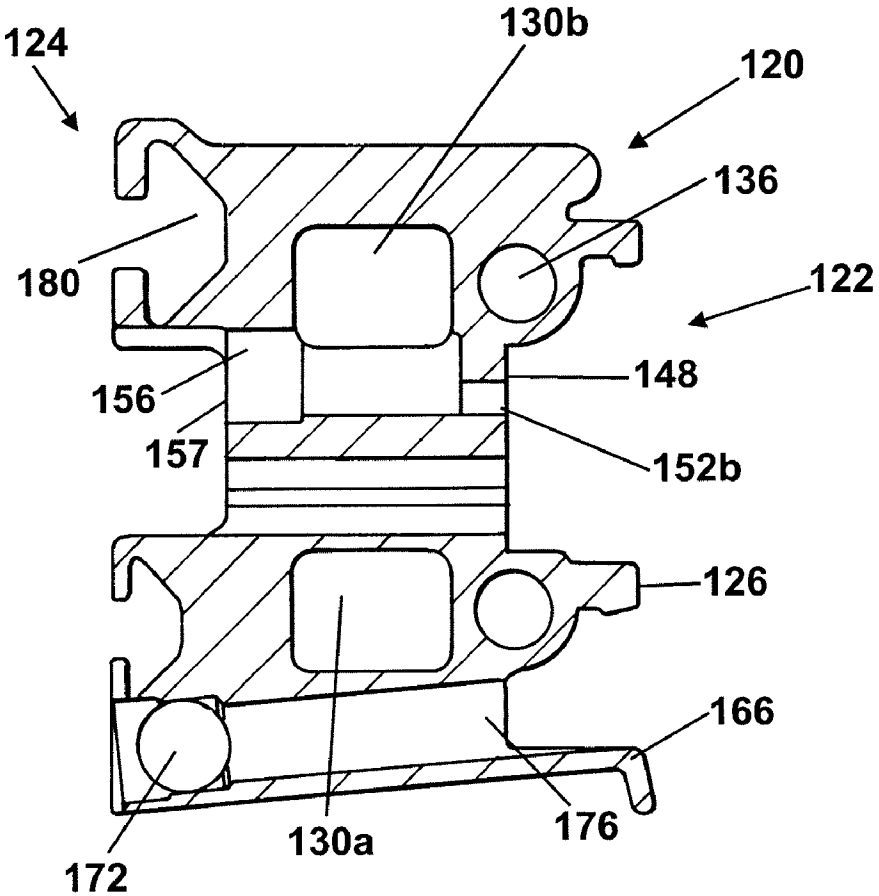
FIG. 4 is a cross section of the print head array carrier of FIG. 2 along section line B-B.
Figure 3:
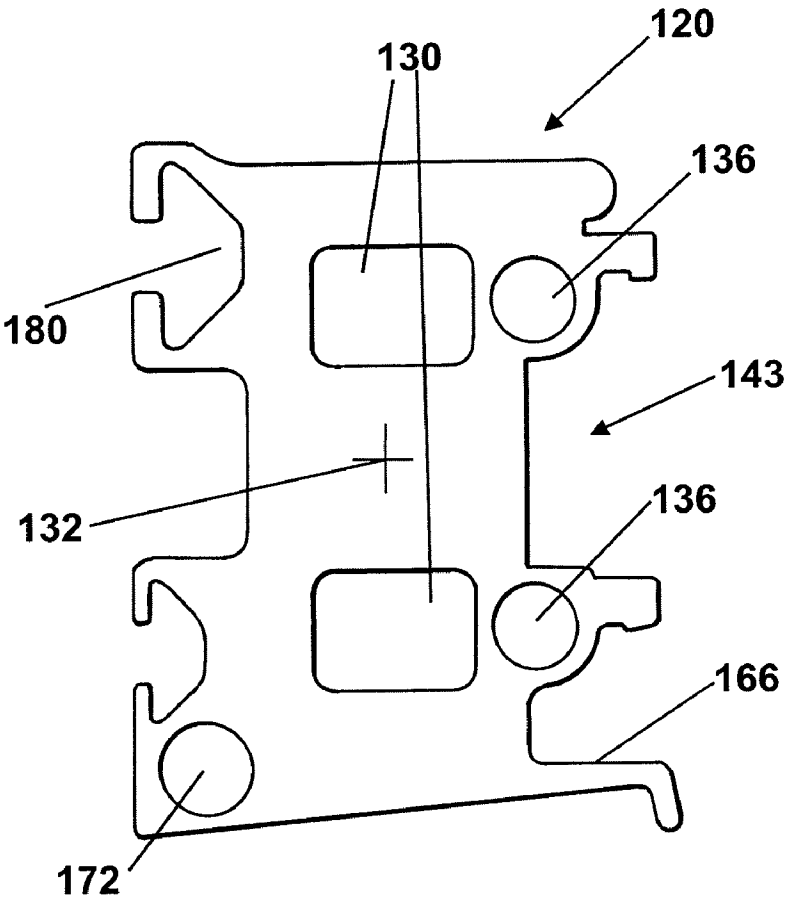
FIG. 3 is a side view of the print head array carrier of FIG. 2 in the direction of arrow A.
Figure 5:
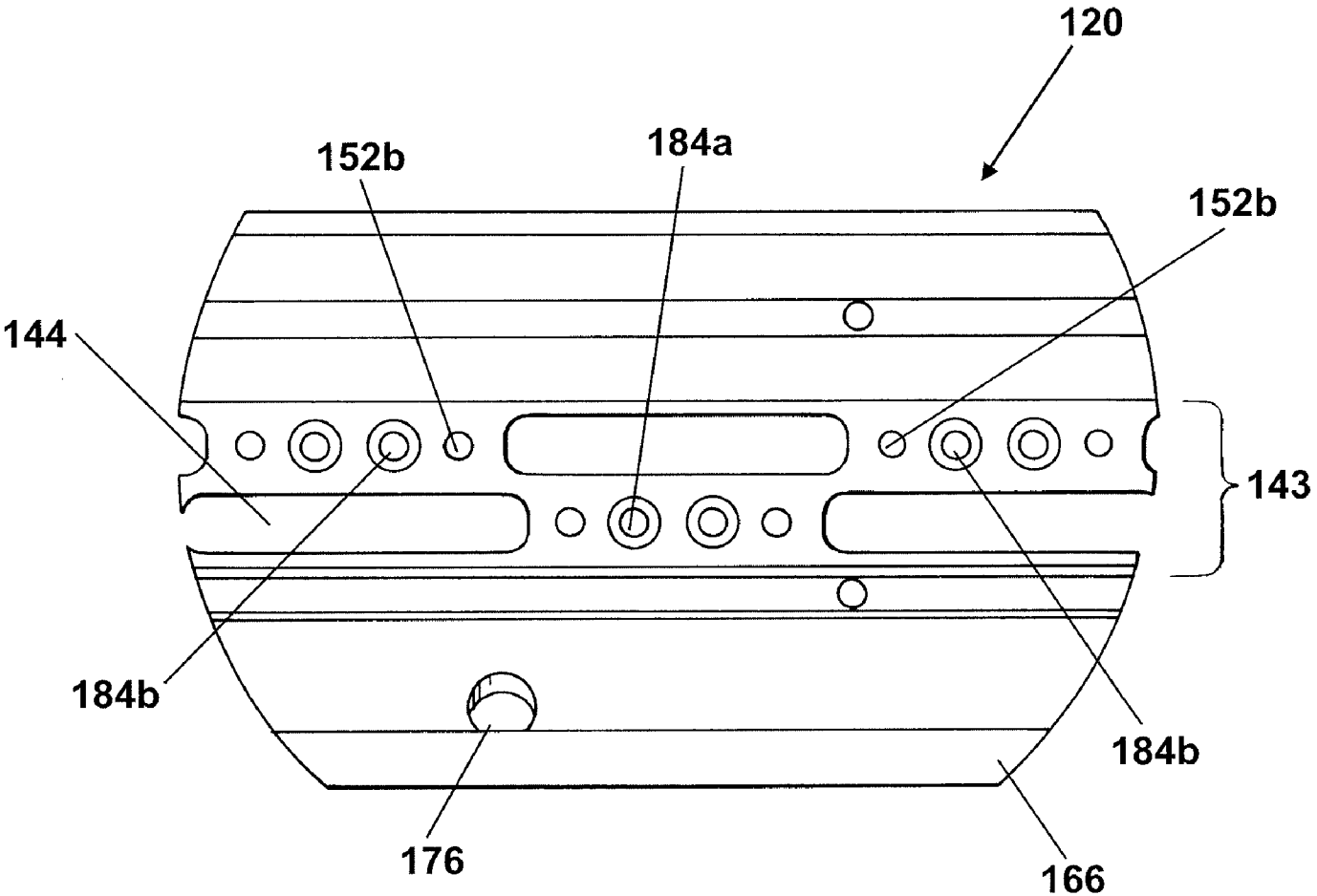
FIG. 5 is a detail view of the area marked C of the print head array carrier in FIG. 2.

With reference to FIGS. 3 and 4, the bar comprises two ink supply passages or conduits 130, extending longitudinally substantially the entire length of the bar 120 (or at least of the part of the bar arranged to receive print heads). The ink conduits 130 are shown on either side of an axis 132 extending through the centre of the bar. The conduits or ducts 130 may be formed while the bar itself is being extruded, or may be formed, e.g. drilled or bored into the bar, at a later time.

A first ink conduit 130*a* has a first ink inlet 210 at a first end of the bar and a second ink inlet 216 at a second, opposite end of the bar (shown schematically in FIG. 1). A second ink conduit 130*b* has a first ink inlet 214 at the second end of the bar and a second ink inlet 212 at the first end of the bar. The ink inlets are provided with filters 218, two of which are shown in FIG. 7.

The bar 120 also comprises two heat transfer conduits or ducts 136 extending longitudinally for substantially the entire length of the bar 120 (or at least of the part of the profile arranged to receive print heads). The heat transfer conduits in use carry heat transfer fluid for regulating the temperature of the array carrier, as described later. Heat transfer fluid may be any suitable fluid, such as water, supplied form a large thermal mass such as a tank 17, shown in FIG. 1.

The heat transfer conduits 136 are disposed adjacent the print head receiving groove 143 and the ink conduits 130, so as to be close to both the print heads and the ink conduits along the full length of the bar, or substantially the full length of the bar. As shown, the heat transfer conduits are located between the ink conduits 130 and the groove 143, partially flanking the groove.

Holes or bores 148 extend from the ink channels 130 to the groove 143, terminating in apertures 152. Pairs of apertures 152 are located such that, in use, ink inlet ports (not shown) in a print head align with the apertures 152, such that the print head is placed in fluid communication with the ink channel 130 via the holes 148.

Pairs of location holes 184 are provided in the printing side 122 of the profile 120 to receive co-operating pairs of pins on each print head 140, to guide each print head into an operating location in the groove 143, in which operating location the inlet ports of the print head are aligned with the apertures 152.

In FIG. 2, it can be seen that the slots 144 and location holes 184 and apertures 152 are provided on alternating sides of the recess 143 to form two rows. The apertures 152*a* on one side of the recess are supplied from a first ink channel 130*a* and the apertures 152*b* on the other side of the recess 143 are supplied from a second ink channel 130*b*. All print heads 140 are densely packed into an area the width of a single print head. However, a print head fitting into a slot 144*a* is a mirror image (about a line 145 along the centre of the groove 143) of a print head fitting into a slot 144*b*.

With reference to FIG. 6, after print head modules have been inserted into slots 144, a plate 192 is secured onto face 126, sealing the print head receiving area 200. The plate 192 is secured to face 126 by any suitable means, such as screws, or a push fit. The plate 192 protects the print heads 140 from accidental contact with media that could damage the print heads. The plate 192 comprises apertures through which nozzle plates 168 of the print heads extend. A sealing gasket 170 is positioned around each nozzle plate 168 to seal the print head 140 inside groove 143, preventing ink or debris from entering the area 200 and flowing inside the carrier and damaging the print head electronics 188. The seal may be a hermetic seal. Sealing area 200 simplifies temperature stabilisation of the print head, as the print head is not directly in contact with the atmosphere external to the carrier 120 and so is less susceptible to changes in the temperature of that atmosphere.

The carrier 120 comprises a channel 165 terminating in a guard 166. Ink or waste that accumulates on plate 192 is removed to the channel 165 in the direction of arrow 196 by a cleaning action, such as wiping or vacuum action. Waste and debris collecting in channel 165 are removed from the carrier by a vacuum pump 16 (see FIG. 1) communicating with a waste outlet 172 and a drain or drains 176.

The carrier bar 120 is arranged such that ink flowing within an ink conduit 130 is in communication with the atmosphere external to the ink conduit, and external to the ink system (which includes ink tank(s) 12 and supply tubes 14*a* and 14*b*, as well as ink conduits 130, holes 148 and print heads 140), to regulate the pressure of the ink. At least one pressure regulation duct, or chamber, 156 is provided in each conduit. The duct 156 comprises a thin flexible filter membrane or film 157 (see FIG. 4) to prevent debris from entering the ink conduit. In use, the duct or chamber 156 contains a volume of ink that is in fluid communication with ink within the ink conduit. The volume of ink in the duct 156 increases or decreases as pressure within the ink conduit begins to change, and so prevents a dramatic pressure change from occurring.

The carrier bar 120 also comprises at least one temperature sensor 160 arranged in use to be in contact with ink flowing in one or both of the ink conduits 130. The temperature sensor 160 is located in the duct 156 and is in communication with the controller 6. The sensor is able to measure the temperature of ink within the ink conduit 130 and send a signal indicative 10 of that temperature to the controller 6. The controller is operable to adjust the temperature of the heat transfer fluid using the signal as a control input, for example to adjust the temperature of the heat transfer fluid if the signal is outside a predefined temperature range.

The operation of the printer in use will now be described.

Ink from the tank 12 is supplied to the first ink conduit 130*a* via inlet ports 210 and 216 and to the second ink conduit 130*b* via inlet ports 214 and 212 along supply tubes 14*a* and 14*b* Ink completely fills the conduits 130 and the bores 148 due to the continual flow of ink from the ink tank 12. During printing, or testing of the print heads, some ink exits the carrier through the nozzles of the print heads 140, which operate in a conventional manner.

The ink supply conduits 130 and holes 148 are entirely internal to the bar or profile 120. In order to supply ink to the array of print heads 140 only the supply tubes 14*a* and 14*b* need to be connected to the bar. No other tubes are required, dramatically reducing the number of tubes required to supply ink to an array from two per print head (which may result in hundreds of tubes) to four per array.

The bar is extruded to form a single piece of material, for example aluminium, and so does not possess any joints which might require sealing, removing any possibility of ink leaking from the profile itself. Any ink leakage that does occur can swiftly be identified as leakage from the seals around the supply tubes 14 or from the print heads 140 themselves.

It will be appreciated that ink flows into the two conduits from two, in this case opposite, directions. Supplying ink in such a way reduces the possibility of print heads distant from an ink inlet experiencing ink starvation, as they might if all the print heads (which might number 300, or 400, or more) were supplied from a single conduit. With the arrangement shown, print heads at both ends of the profile are near to an ink inlet, rather than the print heads at one end being distant from an inlet, with the result that ink is evenly supplied along the length of the bar. Furthermore, using two conduits 130 means that each conduit only supplies half of the print heads (perhaps 150), which again helps to stabilise the pressure of the ink supply.

The heat transfer channels 136 carry heat transfer fluid (sometimes herein termed 'coolant') though the carrier. It will be noted that the coolant/heat transfer fluid may actually be hotter than the bar that defines the channels 136 and so may be heating, rather than cooling.

Two heat transfer conduits 136 are shown, one to stabilise or control the temperature of each ink conduit. It will be appreciated that instead only one heat transfer conduit could be provided to control the temperature of both ink conduits.

The heat transfer fluid has a number of purposes. Firstly, it is necessary to maintain the carrier at a desired temperature during printing, or within a desired acceptable temperature range, by either heating or cooling, as required. A carrier without temperature control will heat up during printing, as a result of the heat that is unavoidably generated by the print heads 140 and their associated electronics 188. As a result, the profile will change size as its temperature increases, adversely affecting print quality. Maintaining the profile at approximately the same temperature during a print run ensures that the dimensions of the carrier remain constant during the print run. For example, the profile may be heated to a normal operating temperature initially before printing begins, and then maintained at that temperature, or the profile may be cooled during printing to prevent the temperature rising above the initial temperature.

Secondly, the viscosity of an ink changes with temperature, affecting its printing properties. Some inks (such as ultraviolet inks) must be heated in order to obtain proper printing properties. Heating the ink itself before it is supplied to the carrier is not satisfactory, as the ink will cool as it travels away from the heat source, meaning that the temperature of the ink varies over the length of the array, resulting in colour or intensity variation within a printed image. The coolant conduits are located adjacent the ink conduits in order to heat (or cool) the ink itself, as well as the profile, along the entire length of the bar, thus maintaining a constant ink temperature. The temperature of the ink along the length of the array is thereby controlled to be more consistent/uniform than has hitherto been possible.

Finally, in order to ensure that the ink remains at its optimum printing temperature as it is delivered to the print heads, the coolant conduits are located between the ink conduits 130 and the recess 143, adjacent the bores 148.

The fluid within the heat transfer conduit is thus able to transfer heat to (that is, heat or cool) the profile, the print heads and ink in the ink conduits 130 simultaneously.

Before operation of the printer, a preferred operative temperature is selected (typically selected by a software or hardware control in the printer controller being set to a particular temperature). This will usually be a temperature at which the printing properties of the ink being used are well known, and at which the printer can operate for the length of the print run without overheating. Usually, the temperature will include an acceptable operating range, of perhaps ±0.1 degrees centigrade, within which the printer can be operated without the print quality dramatically altering. Such a range must take into account, and may be limited by, the dimensional variation of the carrier itself might experience over that range.

In advance of printing, the temperature control fluid in the tank 17 is heated, for example in the tank, to the desired predetermined temperature. Before printing begins, ink and temperature control fluid are both circulated through their respective conduits in the carrier until the temperature sensor indicates that the ink has reached its operating temperature. The carrier itself is designed to have excellent thermal transfer properties, such that a signal indicating the ink has reached the predetermined temperature implies that the carrier itself has also reached that temperature, or is at least within the operating temperature range.

Alternatively, or additionally, the ink might be pre-heated. In that case, it may be desirable to provide an additional temperature sensor, to monitor the temperature of the carrier, to ensure that the carrier, as well as the ink, has reached the operating temperature.

Figure 11:
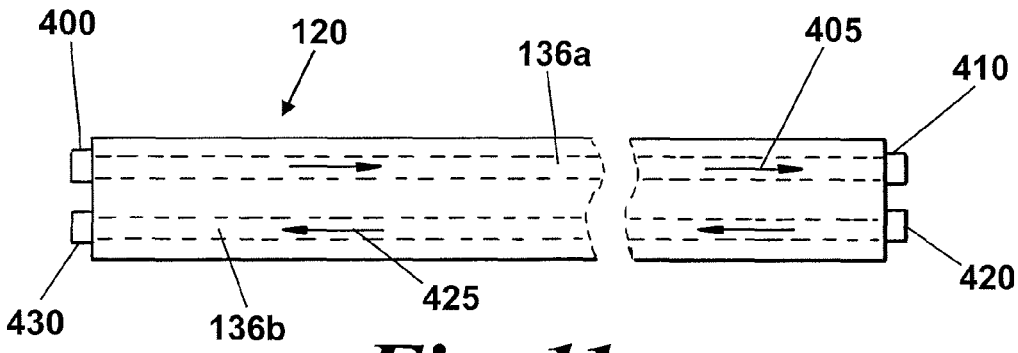
FIG. 11 is a schematic depiction of one embodiment showing heat transfer fluid flowing in heat transfer conduits in a carrier.

Heat transfer fluid is circulated along each heat transfer conduit 136 in opposite directions, as shown in FIG. 11. As the heat transfer fluid flows from an inlet along the bar to an outlet, its temperature will change, as heat is transferred between the fluid and the bar, ink and/or print heads. If only one heat transfer conduit were provided, or two in which the fluid flowed in the same direction, then a temperature gradient would eventually establish along the bar, with one end being hotter than the other, causing the print characteristics to vary along the bar. Providing two conduits 136 in which heat transfer fluid flows in opposite directions means that coolant at the desired temperature (or in the desired range) is supplied to both ends of the bar. This substantially reduces any temperature gradient that develops.

FIG. 11 shows that heat transfer fluid supplied from tank 17 enters a first heat transfer conduit 136 via inlet 400 and exits via outlet 410, flowing along the conduit in a direction indicated by arrow 405. In contrast, heat transfer fluid supplied from tank 17 enters a second heat transfer conduit **136*b* via inlet 420 at an opposite end of the bar 120 from inlet 400, and exits via outlet 430. Fluid in the second conduit 136*b* flows along the bar in a direction indicated by arrow 425, opposite to the direction 405**.

Once the ink and carrier both reach the operating temperature, printing may commence. The temperature sensor continuously or periodically (for example once every one, two, five, or ten minutes) records the temperature of the ink and feeds a signal indicative of that temperature back to the printer controller. The temperature may record the ink temperature on demand from the controller, or from a printer operator, or entirely automatically.

If the temperature is within the acceptable range, the controller does nothing, and merely continues to monitor the temperature. However, if the temperature is outside the acceptable range, the controller acts to return the temperature of the ink to within the acceptable range. For example, the controller may lower or increase the temperature of the coolant, or increase or decrease the flow rate of the coolant, in order to decrease or increase the amount of heat transferred into or away from the bar or raise the temperature of the ink, until the signal from the sensor indicates that that the temperature of the ink has returned to within the acceptable range.

Alternatively, the controller may adjust the temperature or flow rate of the heat transfer fluid when the ink temperature approaches the edge of the acceptable range, in order to ensure that the ink temperature does not leave that range.

Figure 10:
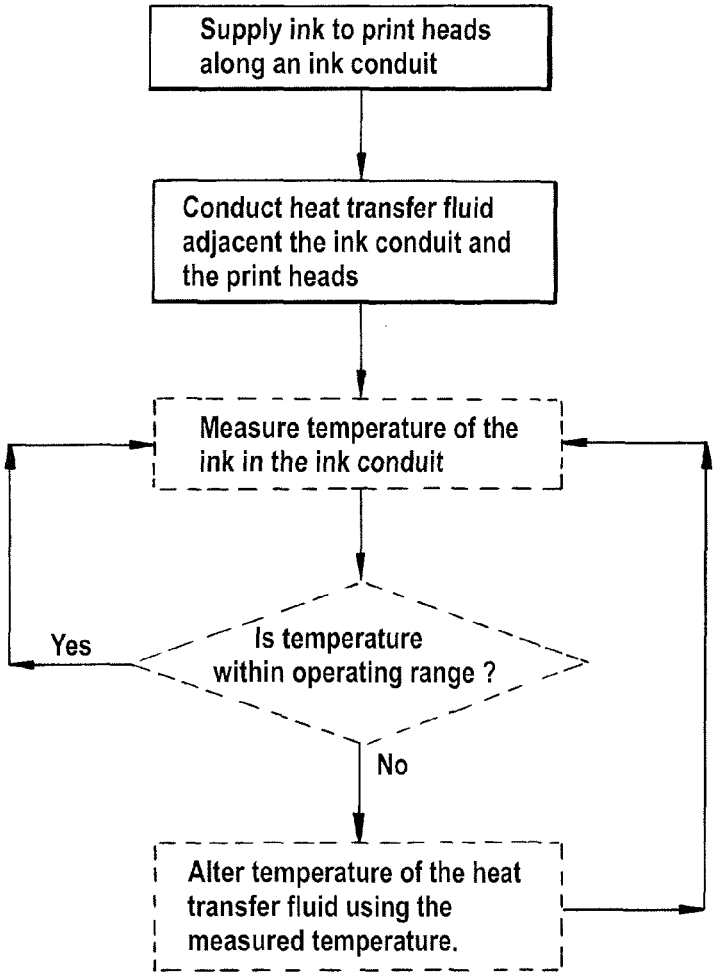
FIG. 10 is a flow chart depicting the steps involved in one embodiment of a method of regulating temperature in a print head array.

FIG. 10 is a flow chart setting out the steps of the above method. Ink is supplied to the print heads 140 along an ink conduit 130. Heat transfer fluid is conducted adjacent the ink conduit and the print heads so as to regulate a temperature of the ink in the ink conduits, the array carrier, and the print heads. Regulation may occur either by transfer of heat to or from those components or by maintaining those components at their existing temperature.

Broken lines indicate optional steps which are present in the particular embodiment of FIG. 10, but which are not present in another embodiment which omits one, some, or all, of those steps. The temperature of ink within the ink conduit is measured periodically by a temperature sensor. If the temperature is within an acceptable operating temperature range, the temperature of the coolant is not adjusted, and the temperature is measured again at a later time. If the temperature is not within an acceptable operating range, a temperature of the coolant is adjusted with the aim of returning the temperature of the ink to within the operating range. The temperature is measured again, at the next regular temperature measurement. The steps are repeated until printing stops.

Figure 8:
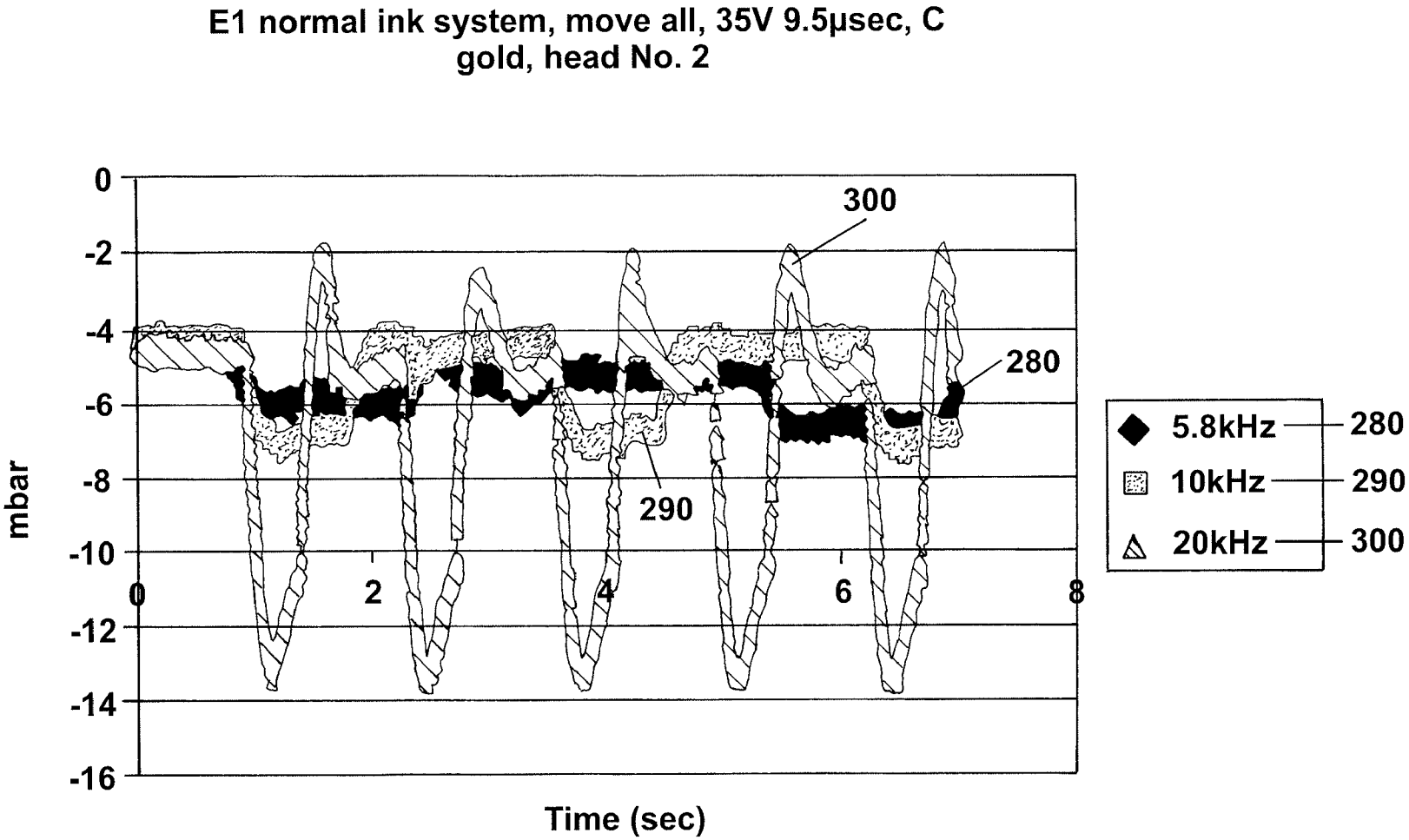
FIG. 8 is a graph illustrating the change in pressure in a prior art ink delivery system (without an opening in accordance with the invention) operating at 5.8 kHz, 10 kHz and 20 kHz.

During printing, particularly at the start and end of printing, the print heads may experience a problem known as 'ink surge' or 'water hammer'. When a large number of nozzles begin printing simultaneously, a lower pressure area is created in the ink system near the print heads, as the ink tank is not supplying the print heads quickly enough to meet the demand. This results in ink starvation for the operating nozzles. Similarly, when a large number of nozzles cease printing simultaneously, excessive pressure may build up within the ink system. FIG. 8 shows the variation within an existing ink system. It can be seen that the pressure within the system varies dramatically over time, and that the variation increases as the frequency of nozzle operation increases However, in an ink system in communication with the atmosphere external to the ink system, via any suitable means, such as a thin flexible member, or membrane, or with a surface of the ink in direct communication with the atmosphere, retained by surface tension, the effect of ink surge is far less pronounced.

Figure 9:
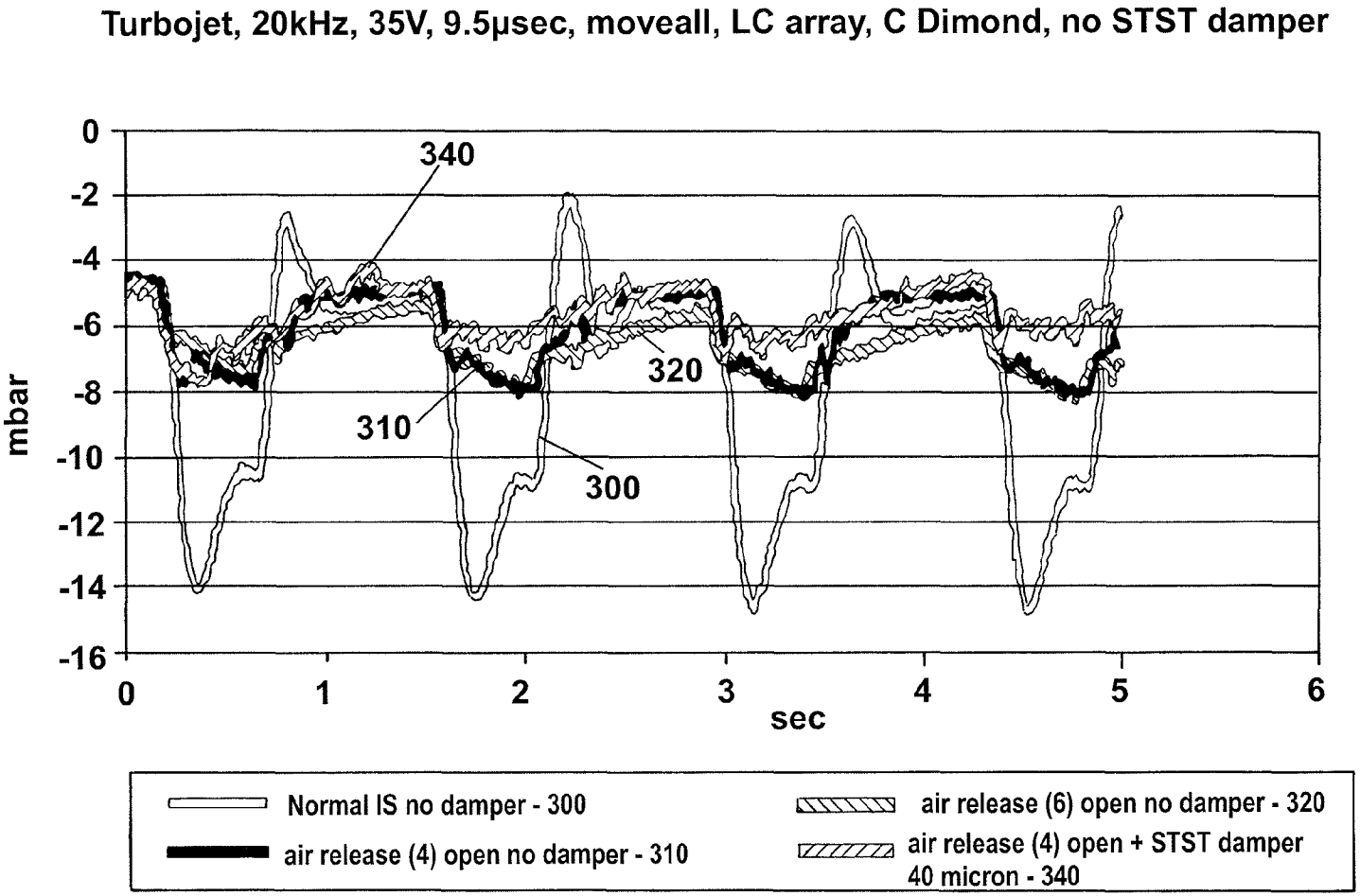
FIG. 9 is a similar graph illustrating the changes in pressure in one embodiment of an ink system in accordance with the invention operating at 20 kHz, compared to a prior art system operating at 20 kHz.

As pressure in the ink system builds up, the volume of ink in duct 156 increases. If a film is present the film is pushed outwards. Thus the volume of the system is increased and the pressure within the ink conduit is proportionally decreased. Similarly, if the pressure within the ink system is too low, the volume of ink in duct 156 decreases, reducing the volume of the ink system and increasing the pressure within the ink conduit. The volume in the duct alters under the force due to atmospheric pressure until the force on one side of the ink surface due to the external atmosphere approximately equals the force due to the ink pressure on the other side of the surface. The ink duct 156 thus acts to equalise the two pressures (that is, minimise the differential pressure across the ink surface). FIG. 9 shows how the pressure within a printer having no pressure regulation duct 156, depicted by line 300, varies dramatically between −2 and −14 mbar, while the pressure in systems having an 'air release' duct 156, depicted by lines 310, 320 and 340, varies far less, between about −4 and −8 mbar. Thus allowing the ink conduit to communicate with the atmosphere external to the conduit, whatever that might be (usually air), effectively reduces the pressure variation from 12 mbar to 4 mbar.

The invention claimed is:

1. A carrier for an array comprising a plurality of print heads, the carrier comprising:

an elongate bar comprising a number of ink conduits extending through the elongate bar in a longitudinal direction, a print head receiving area to which the plurality of print heads mount, a number of heat transfer fluid conduits extending through the elongate bar in a longitudinal direction, a number of apertures defined in the carrier that fluidly couple each print head mounted in the print head receiving area with the ink conduits, in which the heat transfer fluid conduits are disposed adjacent both the ink conduits and the print head receiving area, and in which the number of heat transfer fluid conduits comprise a first heat transfer fluid conduit and a second heat transfer fluid conduit, the first heat transfer conduit comprising a first heat transfer fluid inlet adjacent a first end of the carrier, and the second heat transfer conduit comprising a second heat transfer fluid inlet adjacent a second end of the carrier, different from the first end, such that in use heat transfer fluid is conducted along the first and second heat transfer conduits in opposite directions.

2. A print head array carrier according to claim 1 wherein the number of heat transfer fluid conduits are disposed along the number of ink conduits so as to regulate a temperature of ink in the number of ink conduits.

3. A print head array carrier according to claim 1, in which the first ink conduit and a second ink conduit supply ink to alternating print heads.

4. A print head array carrier according to claim 1 wherein the print head receiving area comprises a longitudinal groove.

5. A print head array carrier according to claim 1 wherein the print head receiving area further comprises pairs of location holes that receive co-operating pairs of pins on each print head that guide each print head into an operation location in which each print head is fluid communication with said ink conduit.

6. A print head array carrier according to claim 1 further comprising a sealing plate that seals the plurality of print heads within the print head receiving area.

7. A print head array carrier according to claim 1 wherein the ink conduit comprises a duct with a flexible film that flexes to increase or decrease a volume of the ink conduit thereby regulating ink pressure within said ink conduit.

8. A print head array carrier according to claim 1 further comprising a waste channel, that collects waste from the print heads.

9. A print head array carrier according to claim 8, further comprising a pump fluidly coupled to an outlet of the waste channel, in which the pump removes waste from the waste channel.

10. An inkjet printer comprising:

a carrier for an array of print heads, the carrier comprising:

an elongate bar comprising a number of ink conduits extending through the elongate bar in a longitudinal direction, and a number of heat transfer fluid conduits extending through the elongate bar in a longitudinal direction, in which the heat transfer conduits comprise a first heat transfer conduit and a second heat transfer conduit, and in which a heat transfer fluid is conducted along the first heat transfer conduit and second heat transfer conduit in opposite directions, the first heat transfer conduit comprises a first inlet and a first outlet on different ends of the carrier and the second heat transfer conduit comprises a second inlet and a second outlet on different ends of the carrier.

11. A printer according to claim 10, further comprising a plurality of print head array carriers.

12. A printer according to claim 10, further comprising a controller that receives an output of a temperature sensor thermally coupled to the ink and adjusts a temperature of the heat transfer fluid flowing within the number of heat transfer fluid conduits based on the output of the temperature sensor.

13. A printer according to claim 12, further comprising a plurality of carriers, each carrier comprising a number of the temperature sensors, in which the controller adjusts a temperature of the heat transfer fluid flowing within one heat transfer fluid conduit independently of a temperature of the heat transfer fluid flowing within the other heat transfer fluid conduits.

14. A method of regulating temperature in a print head array comprising:

supplying ink to a plurality of print heads carried on a print head array carrier via an ink conduit defined in the array carrier;

circulating heat transfer fluid adjacent the ink conduit and the print heads via a first heat transfer fluid conduit and a second heat transfer fluid conduit defined in the array carrier;

measuring a temperature of the ink in the ink conduit; and altering a temperature of the heat transfer fluid using the measured temperature;

in which the heat transfer fluid simultaneously regulates the temperature of the array carrier, the ink in the ink conduit, and the print heads, and in which the first heat transfer conduit comprising a first heat transfer fluid inlet adjacent a first end of the carrier, and the second heat transfer conduit comprises a second heat transfer fluid inlet adjacent a second end of the carrier, different from the first end, such that in use heat transfer fluid is conducted along the first and second heat transfer conduits in opposite directions.

15. A process of printing using a print head array comprising a plurality of print heads carried on a print head carrier, comprising controlling the temperature of a number of print heads and ink going to the print heads during printing by controlling the temperature of a heat transfer fluid that is in a number of heat transfer conduits disposed between the print heads and an ink supply conduit from which the print heads receive the ink, in which the heat transfer conduits comprise a first heat transfer conduit and a second heat transfer conduit, the first heat transfer conduit comprising a first heat transfer fluid inlet adjacent a first end of the print head carrier, and the second heat transfer conduit comprising a second heat transfer fluid inlet adjacent a second end of the print head carrier, different from the first end, in which the method further comprises conducting the heat transfer fluid in the first heat transfer conduit in an opposite direction as the heat transfer fluid in the second heat transfer conduit.

16. The carrier of claim 1, further comprising a number of temperature sensors thermally coupled to an ink circulating through the ink conduits that detects the temperature of the ink on the ink conduits.

17. The carrier of claim 1, further comprising a controller to adjust the temperature of a heat transfer fluid circulating through the heat transfer fluid conduits based on the temperature of the ink detected by a temperature sensor.

* * * * *